US005992501A

United States Patent [19]

El Gammal et al.

[11] Patent Number: 5,992,501

[45] Date of Patent: Nov. 30, 1999

[54] FLOOR LEAD-THROUGH ELEMENT FOR AN INVERSION CASTING VESSEL

[75] Inventors: Tarek El Gammal; Peter Hamacher, both of Aachen; Michael Vonderbank, Xanten; Fritz-Peter Pleschiutschnigg, Duisburg; Ingo Von Hagen, Krefeld, all of Germany

[73] Assignee: Mannesmann Aktiengesellschaft, Düsseldorf, Germany

[21] Appl. No.: 08/913,181

[22] PCT Filed: Feb. 7, 1996

[86] PCT No.: PCT/DE96/00256

§ 371 Date: Oct. 14, 1997

§ 102(e) Date: Oct. 14, 1997

[87] PCT Pub. No.: WO96/27465

PCT Pub. Date: Sep. 12, 1996

[30] Foreign Application Priority Data

Mar. 8, 1995 [DE] Germany ..... 195 09 691

[51] Int. Cl.[6] ..... B22D 11/00; B22D 19/00; B22D 23/04

[52] U.S. Cl. ..... 164/461; 118/69; 118/405; 118/429; 164/419; 427/431; 427/434.2; 427/436

[58] Field of Search ..... 164/461, 419; 118/429, 405, 419, 69; 427/431, 434.2, 436

[56] References Cited

U.S. PATENT DOCUMENTS

| | | | |
|---|---|---|---|
| 2,128,943 | 9/1938 | Hudson | 164/419 X |
| 3,470,939 | 10/1969 | Coad | 164/419 X |
| 4,479,530 | 10/1984 | Ekerot | 164/461 |

FOREIGN PATENT DOCUMENTS

| | | | |
|---|---|---|---|
| 56-151163 | 11/1981 | Japan | 164/461 |
| 57-97862 | 6/1982 | Japan | 164/461 |

*Primary Examiner*—J. Reed Batten, Jr.
*Attorney, Agent, or Firm*—Cohen, Pontani, Lieberman & Pavane

[57] ABSTRACT

An inversion casting vessel includes a melt-filled container with a hole in the floor through which a metal strip is drawn. As the strip is drawn through the container, crystallization of the melt on the metal strip occurs, thereby forming a metal strand. The hole in the floor is a slit shaped channel through which the strip is run in a low-contact manner. The container also includes a cooling device for cooling the melt in the area of the slit shaped channel. The cooling device maintains the temperature of the melt around the channel to create a two-phase field of the melt, one of the phases being crystal, making up 50%–90% of the two phase field. The metal strip first contacts the melt at the two-phase field of the melt as the strip is run through the melt container.

4 Claims, 4 Drawing Sheets

FLOOR LEAD-THROUGH ELEMENT FOR AN INVERSION CASTING VESSEL

FIELD OF THE PRESENT INVENTION

The present invention relates to a process and a device for producing thin metal strands, especially steel, in which a metal strip is drawn through the floor of a melt-filled container and, after crystallization of melt on the strip, is guided via drivable rollers arranged above the container.

BACKGROUND OF THE INVENTION

The continuous casting process of the present invention is sometimes referred to as inversion casting, because solidification takes places from the inside of the strip to the outside, rather than from the outside to the inside as in standard continuous casting.

Such a process is known for producing wire, in particular, but also for casting strips. For example, U.S. Pat. No. 3,264,692 discloses a casting vessel with a zircon brick floor for a strip casting process. The slit-shaped opening in the floor brick is matched with narrow tolerances to the dimensions of the strip drawn through it.

A disadvantage of this known floor inlet is the relatively high risk that the strip will jam if its measurements deviate even slightly from the permitted size or its course is rough and therefore accompanied by increased friction.

From WO-A-87 07 102, a device for producing thin metal strands is known that has a vessel equipped with a refractory-grade lining, in whose floor an opening is provided for inserting a metal strip, the opening being embodied as a slit-shaped channel. To obtain a large total thickness of the strip, the strip can be drawn through the melt in several cycles.

Another device for producing thin metal strips is known from DE-A-36 38 249. Here, a certain distance is maintained between the channel wall and the strip to be coated.

Finally, U.S. Pat. No. 3,264,692 should be mentioned. In the device described there, a certain material is used for the inlet channel. This is done to prevent an expansion of the material from causing the metal strip to become stuck in the channel.

From U.S. Pat. No. 4,479,530, a process is known for passing wire through a melt-in this case, however, from top to floor-and then running the wire through the floor outlet of a melt vessel. In this process, which is designed to produce copper wire, it is proposed to embody the floor outlet in conical fashion, and also to deliberately allow melt to emerge from the outlet along with wire.

A similar device, again for producing wire, is known from the article "A Continuous Casting Process" in the *Journal of Metals,* October 1963, pp. 774–780. This article describes a floor opening that is made of molybdenum and can be cooled by water.

The two latter documents relate to the production of wire from copper and are not transferable to processes and devices for the production of steel strip. It should be noted that in wire production, the diameter of the wire is irregular, due to bulges in the crystallized layer. The wire must therefore be further processed to be of practical use. It is also disadvantageous that low crystallization and poor bonding often result from the large size of the mother wire, which can be 6 mm thick or larger.

SUMMARY OF THE PRESENT INVENTION

The object of the invention is to discover a process and a device, to avoid mechanical damage to the strip upon its entrance into the melt vessel, to prevent uncontrolled tensile stress conditions that result from increased friction (abrasion risk), and to prevent the melt from flowing out of the container.

The object of the present invention is met by a process for producing thin metal strips, in which a metal strip is drawn through a floor of a melt-filled container and, after the crystallization of the melt on the strip, is withdrawn by drivable rolls arranged above the container, comprising the steps of, running the metal strip through a slit-shaped channel in the floor of the container in low-contact manner toward the container interior; cooling the melt in the region of the mouth of the channel to a temperature to such an extent that a two-phase field is formed in the region of the mouth of the channel having melt and crystals wherein the crystals comprise a percent share of the two-phase field in the range including 50% to 90%; forming a meniscus when the metal strip comes into contact with this cool quantity of melt in the region of the mouth of the channel, and, cooling the melt in the vicinity of the meniscus in a two-phase field of melt and crystal at a temperature closely above the solidus point.

According to the invention, the melt bath is cooled so intensely in the region of the mouth of the slit-shaped entrance into the vessel that a temperature drop occurs in this region. The result is a two-phase melt/crystal field slightly above the solidification point.

This two-phase field, which also comes into contact with the cold mother strip, has such high viscosity that it acts as a self-renewing seal, preventing the melt from entering the slit or the floor opening.

The melt that acts as a seal expands to such an extent that the empty space between the inner wall of the slit-shaped channel of the floor entrance and the strip passed through this channel can have a size selected to ensure the contact-free passage of the strip through the slit-shaped channel, thanks not least to the meniscus that forms.

Because almost no mechanical contact occurs between the strip and the channel, even copper can be used as a channel material. For protection against abrasive wear, the copper can be provided with a protective layer. Suggested coatings are metals (chrome, nickel), oxides (zirconium oxide) and ceramics (e.g., boron nitride).

In another advantageous embodiment, the cooling element on the wall directed toward the vessel is covered by a layer of refractory-grade mass. This measure provides greater protection for the cooling element. The measure also allows influence to be exercised on the temperature level of the melt, which, comparable to a charge, is colder in the vicinity of the cooling element.

A low-maintenance and economical slit-shaped channel can be embodied in two parts. One part consists of copper, as described, while the other part, directed away from the melt, is made of a refractory-grade mass or refractory-grade bricks.

To reliably influence the meniscus, the inventors propose that the cooling element be equipped with a conical opening in the direction of the vessel interior.

A liquid is suggested as the cooling medium, as is gas. If water is used, it is conveyed by means of suction so as to avoid damage in the event of defects in the cooling elements, which cannot be ruled out.

In a special embodiment, cooling tubes that run in a snake-like fashion are used. The tube snake is designed so that cooling runs first in the vicinity of the slit.

Heat extraction from the metal melt in the area of the channel mouth is regulated as a function of melt bath temperature. If there is excessive cooling of the melt, its temperature can be adjusted to the desired level by a heating device, e.g., a plasma burner.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
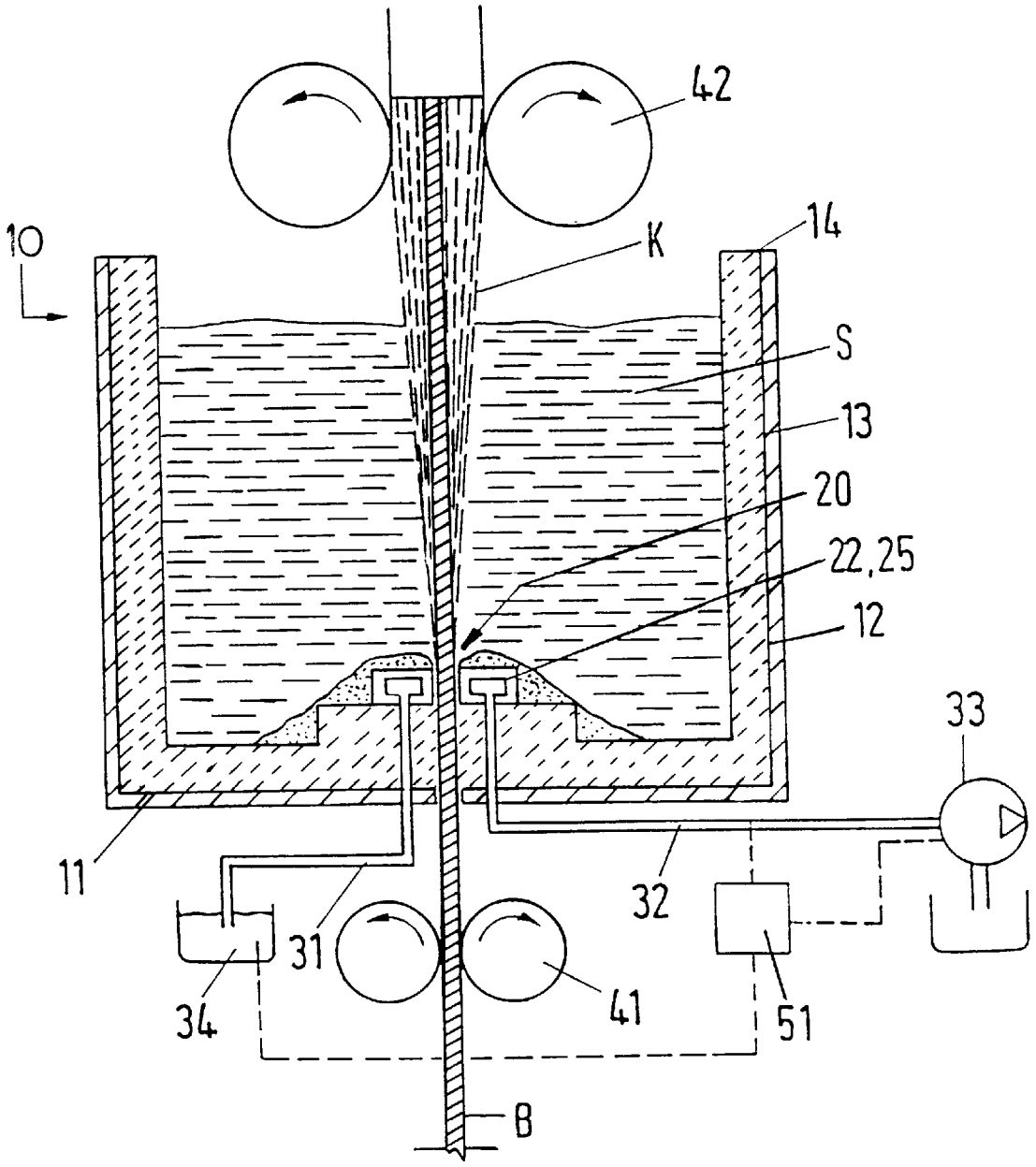
FIG. 1 is a schematic drawing showing a sectional view of the casting device of the present invention.

FIG. 1 shows a melt vessel 10 with a vessel floor 11 and vessel side walls 12, which have a metal vessel casing 13 and a refractory-grade lining 14.

The melt vessel 10 contains a melt S. The vessel floor 11 has a channel 20, whose mouth that faces the melt S has a metal channel part 22, here embodied as a cooling box 25.

The cooling box 25 is connected via a media inlet 31 to a container 34 and via a media outlet 32 to a pump 33.

A strip B is moved by means of guidance rollers 41 through the channel 20 and into the melt vessel 10 that holds the melt S. A layer K crystallizes on the strip B, which is conveyed above the vessel by means of smoothing rollers 42 which smoothed layer K to near its final size.

The media outlet 32 is connected to a device 51 for measurement and control of the heat energy.

Figure 2A:
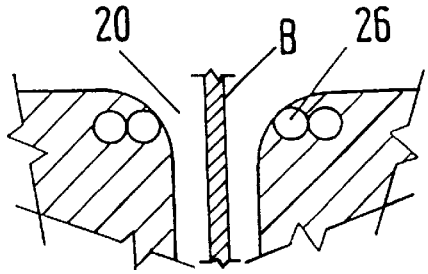
FIG. 2*a* is a sectional view showing an embodiment of a cooling element.
Figure 2B:
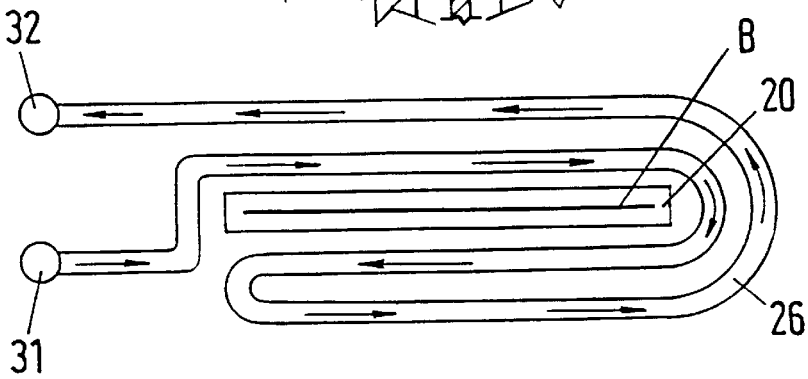
FIG. 2*b* is a schematic plan view of the cooling element of FIG. 2*a;*

FIGS. 2*a* and 2*b* show horizontal sections through the metal channel part 22, embodied here as the cooling tube 26 connected to the inlet 31 and the outlet 32. At the center of the snake-like cooling tube 26, the strip B is passed through the channel 20.

FIGS. 2*a* and 2*b* show an arrangement of two tubes on each of the two sides of the strip. The arrows indicate the flow direction of the cooling medium. As the drawing shows, the cooling medium is first run around the strip in the area of the strip parallel to the cooling snake, then conveyed to the cooling outlet.

Figure 2C:
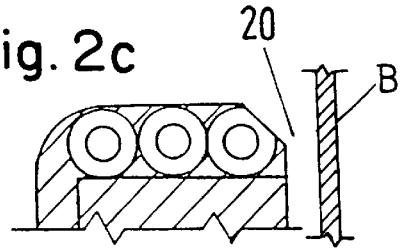
FIG. 2*c* is a partial sectional view of one side of another embodiment of the cooling element.
Figure 2E:
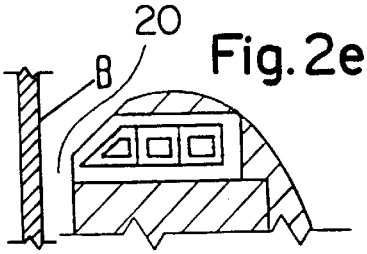
FIG. 2*e* is a partial sectional view of another embodiment of a cooling element of FIG. 2*c;*
Figure 2D:
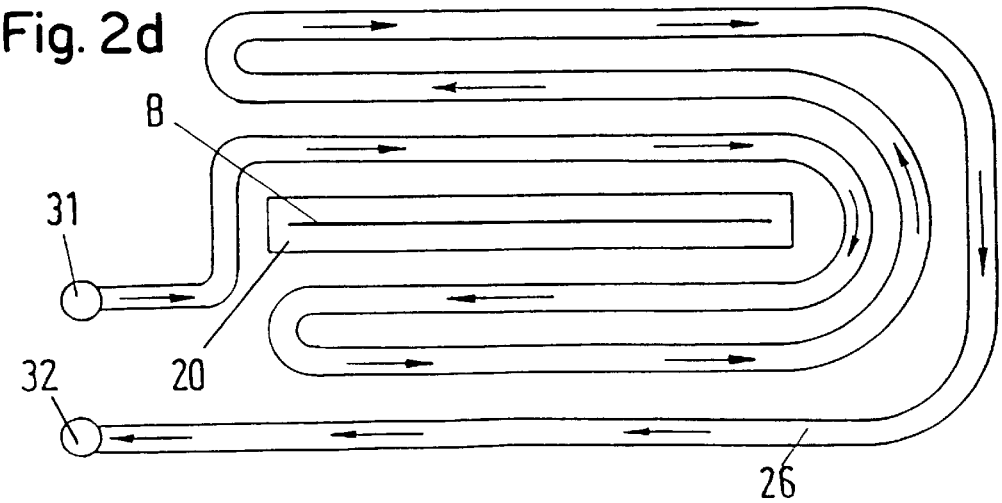
FIG. 2*d* is a schematic plan view of the cooling element of FIG. 2*c;*

FIGS. 2*c* and 2*d* show three tubes arranged parallel to each other. As the drawing indicate, the cooling tube near the strip can be slanted, specifically, in such a way that the channel 20 has a conical mouth in the direction of the vessel interior.

FIGS. 2*c* and 2*d* also show that the cross section of cooling tubes 26 can have a circular profile. Alternatively, as shown in FIG. 2*e*, the tubes 26 may also have a square profile.

Figure 3A:
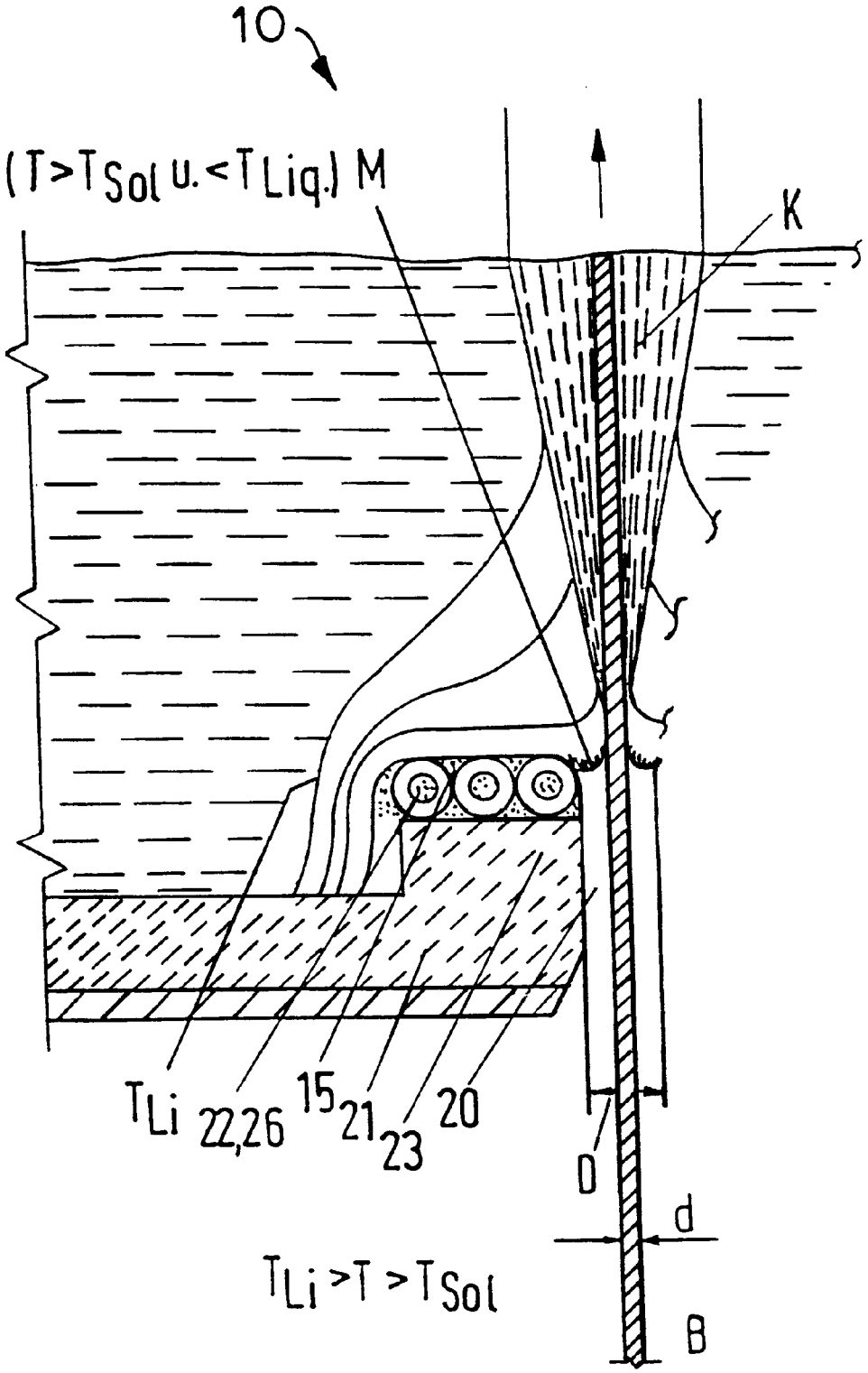
FIG. 3*a* is a partial sectional view showing an embodiment of the casting device of FIG. 1.
Figure 3B:
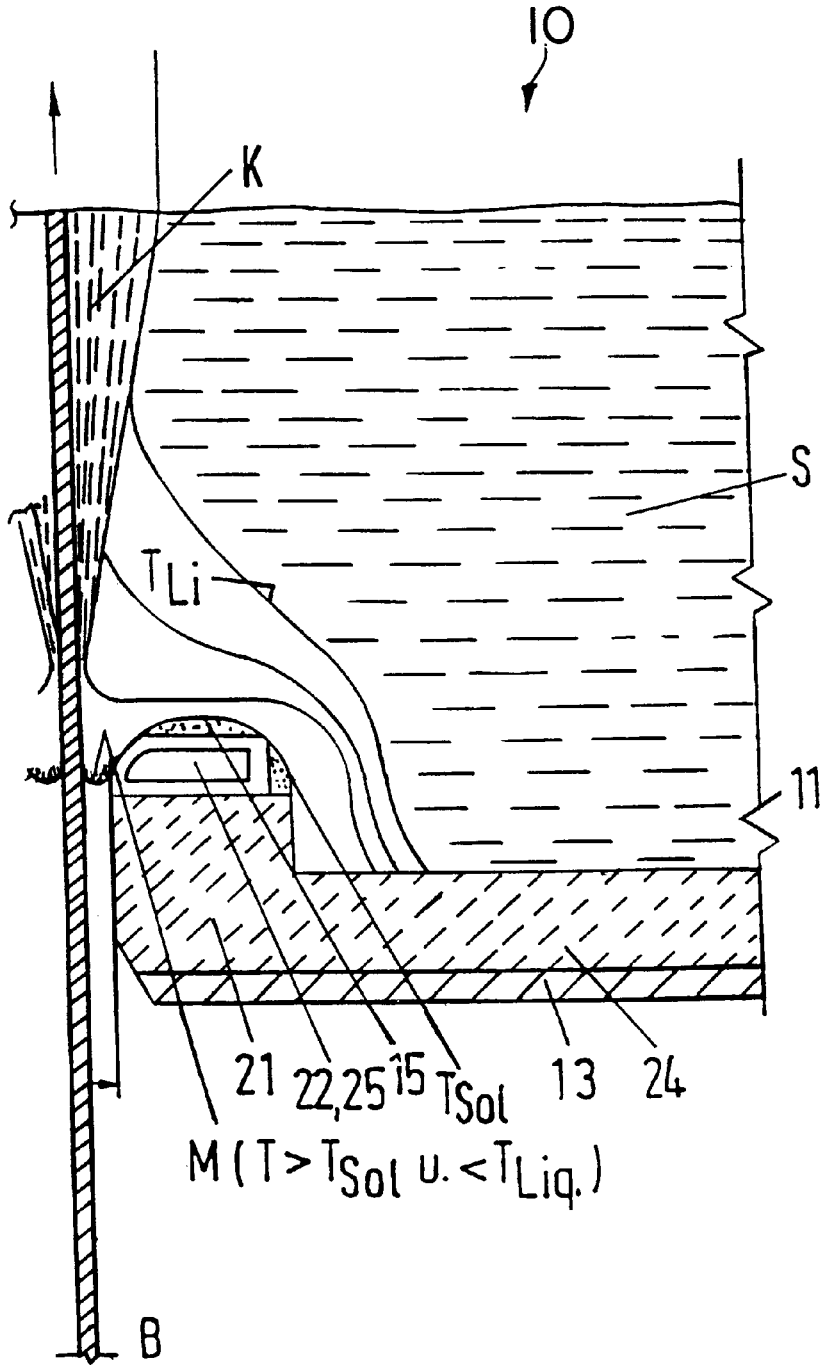
FIG. 3*b* is a partial sectional view showing another embodiment of the casting device of FIG. 1.

FIGS. 3*a* and 3*b* show a section of the melt vessel 10 with the metal casing 13 and the refractory-grade lining 14, depicted as a ramming compound in FIG. 3*b* and as brick in FIG. 3*a*.

The channel 20 has an elevation, which rests, inclined toward the metal casing 13, on a refractory-grade channel part 21, shown as refractory-grade brick 23 in FIG. 3*a* and as refractory-grade ramming compound 24 in FIG. 3*b*.

Inclined toward the melt S is a metal channel part 22, which is shown as the cooling tube 26 in FIG. 3*a* in the drawing and as the cooling box 25 in FIG. 3*b*. In the direction of the interior of the melt vessel 10, this channel part 22 is covered with a refractory-grade layer 15.

The channel 20 has an inner channel thickness D, through which the strip B with a strip thickness d is run.

In the strip direction, a layer K crystallizes on the strip B which is run through the melt S.

FIG. 3*a* also shows isotherms of the melt S. It can be seen that in the slit-shaped channel 20 in the region of the metal channel part 22 a temperature depression is established near the solidification point $T_{SOL}$. This two-phase region of melt/crystal comprises an amount of crystal in the range 50% to 90% and prevents the melt S from flowing out of the melt vessel through the slit-shaped channel.

Starting from the two-phase region, other isotherms are shown, up to the melt temperature $T_{SOL}$. In the area of the slit, a meniscus M forms between the strip B and the cooling box 25 below the cooling tube 26. The shape of the meniscus M that forms depends on the shape of the front of the metal channel part 22, so that when the channel part 22 has a conical front, the meniscus extends more deeply into the slit-shaped channel 20. The melt S itself is not yet completely solid; rather, it is still ductile, but has solidified to the extent that its emergence from the channel 20 is prevented.

We claim:

1. A process for producing thin metal strips, in which a metal strip is drawn through a floor of a melt-filled container and, after the crystallization of the melt on the strip, is withdrawn by drivable rolls arranged above the container, comprising the steps of:

a) running the metal strip through a slit-shaped channel in the floor of the container in a low-contact manner toward the container interior;

b) cooling the melt in the region of the mouth of the channel to a temperature to such an extent that a two-phase field is formed in the region of the mouth of the channel having melt and crystals wherein the crystals comprise a percent share of the two-phase field in the range including 50% to 90%;

c) forming a meniscus when the metal strip comes into contact with this cool quantity of melt in the region of the mouth of the channel, and, cooling the melt in the vicinity of the meniscus in the two-phase field of melt and crystal at a temperature closely above the solidus point.

2. The process of claim 1, further comprising the step of selecting a strip speed such that the meniscus is located in the region of the mouth of the channel.

3. The process of claim 2, wherein said step of cooling further comprises the step of regulating an amount of heat extraction by controlling the flow of a cooling medium through a cooling device as a function of the strip speed.

4. The process of claim 3, wherein the step of regulating an amount of heat extraction further comprises regulating the amount of heat extraction as a function of a temperature of the melt in the container outside of the two-phase field.

* * * * *